US006047625A

United States Patent [19]

Mendenhall

[11] Patent Number: 6,047,625

[45] Date of Patent: Apr. 11, 2000

[54] WEDGE CUT BLADE APPARATUS

[76] Inventor: George A. Mendenhall, 4252 South Eagleson Rd., Boise, Id. 83705

[ * ] Notice: This patent issued on a continued prosecution application filed under 37 CFR 1.53(d), and is subject to the twenty year patent term provisions of 35 U.S.C. 154(a)(2).

[21] Appl. No.: 08/837,616

[22] Filed: Apr. 21, 1997

[51] Int. Cl.[7] ..... B26D 1/02

[52] U.S. Cl. ..... 83/856; 83/857; 83/932

[58] Field of Search ..... 83/98, 856, 857, 83/932

[56] References Cited

U.S. PATENT DOCUMENTS

| | | | |
|---|---|---|---|
| 4,300,429 | 11/1981 | Brown et al. | 83/857 |
| 4,573,384 | 3/1986 | Jones | 83/858 |
| 4,771,664 | 9/1988 | Holz | 83/857 |
| 4,911,045 | 3/1990 | Mendenhall | 83/857 |
| 5,197,681 | 3/1993 | Liebermann | 83/862 |
| 5,235,960 | 8/1993 | Malcok | 125/13.02 |
| 5,303,687 | 4/1994 | Steere | 125/13.02 |
| 5,343,623 | 9/1994 | Cole et al. | 83/468.1 |

FOREIGN PATENT DOCUMENTS

| | | | |
|---|---|---|---|
| 398939 | 9/1933 | United Kingdom | 83/857 |

*Primary Examiner*—M. Rachuba

*Attorney, Agent, or Firm*—Marger Johnson & McCollom, P.C.

[57] ABSTRACT

A wedge cut cutter for food products is disclosed which includes one or more cutter sections mounted between a base plate and an end retainer. Each cutter section includes shoulders and clamping members for clamping each end of one or more elongate blades to the cutter section. Each blade is tensioned by an adjustment screw which bears against a roll pin which, in turn, urges a portion of the blade around a pair of anvils into a recess. The blades of each cutter section, or of adjacent cutter sections are radially offset to cut incoming items into wedge-shaped portions.

31 Claims, 4 Drawing Sheets

WEDGE CUT BLADE APPARATUS

BACKGROUND OF THE INVENTION

This invention relates to a cutting apparatus for cutting food products into wedge-shaped portions, and in particular, a cutting apparatus which utilizes tensioned blades, and which can be configured for cutting food products into any number of wedge shaped portions.

Food products and produce such as potatoes are cut and shaped by being entrained in a process stream of water or brine and passed through a "hydroknife" blade assembly which typically includes multiple blades for cutting the produce into the desired shape and size. For example, the hydroknife cutter assembly disclosed in U.S. Pat. No. 5,095,794 is used for cutting potatoes into elongate, square cross-sectioned pieces for further processing into french fries. Another popular form for processed potatoes is wedge-shaped portions. However, although the prior art includes some cutting assemblies for producing wedge-shaped portions, the prior art does not provide a wedge-cut cutter in which the blades are tensionable, which can be easily reconfigured to cut various numbers of wedge-cuts, and which are otherwise suitable for modern hydraulic cutting systems.

SUMMARY OF THE INVENTION

This invention provides solutions to the needs unmet by the prior art. The invention is embodied in a cutter which includes a first body having a first axial bore, and a first elongate blade traversing the bore. The first blade has first and second end portions attached to respective first and second mounting surfaces milled into the first body. A first recess underlies a portion of the first blade, and a first blade tensioner urges a portion of the first blade toward the first recess. A cutter according to the invention may further include a second elongate blade traversing the bore at an angle to the first blade, the second blade having first and second end portions attached to respective third and fourth mounting surfaces. A second recess underlies a portion of the second blade, and a second blade tensioner urges a portion of the second blade toward the second recess.

A blade tensioner according to the invention is embodied in a first bearing member which bears on the first blade, and a first biasing member bearing on the first bearing member. In the preferred embodiment, the bearing member is a cylindrical pin, and the biasing member is a screw or bolt. The blade tensioners are adjustable to tension the blades to any of a plurality of selectable tensions. A cutter according to the invention may further include a second body similar to the first body, and stacked thereon to provide additional blades as required to achieve the desired number of cuts.

The preferred embodiment includes mounting means for mounting the first and second bodies on an underlying surface. The mounting means includes a base member and means for removably attaching the first body to the base member. An end retainer is fitted atop the stacked body, and through bolts are used to secure the end retainer and stacked cutter bodies to the base plate.

These and additional aspects of the invention are described below with reference to the following drawings.

DETAILED DESCRIPTION

Figure 1:
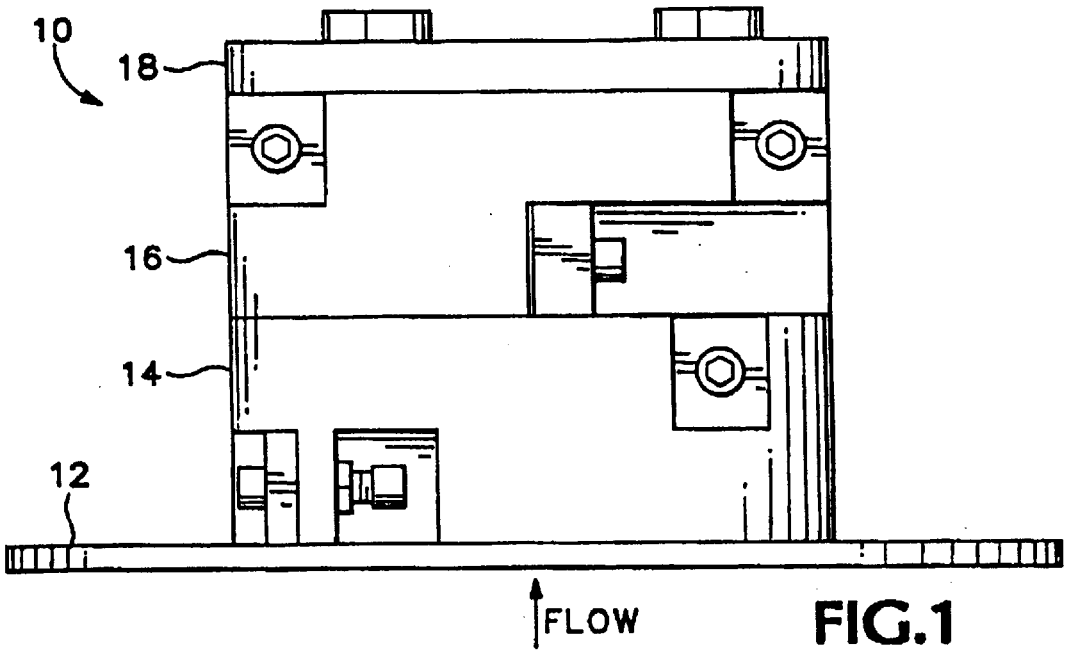
FIG. 1 is a side elevational view of a wedge cutter assembly according to the present invention which includes two 2-blade cutter sections, an end cap, and a bottom mounting plate.
Figure 2:
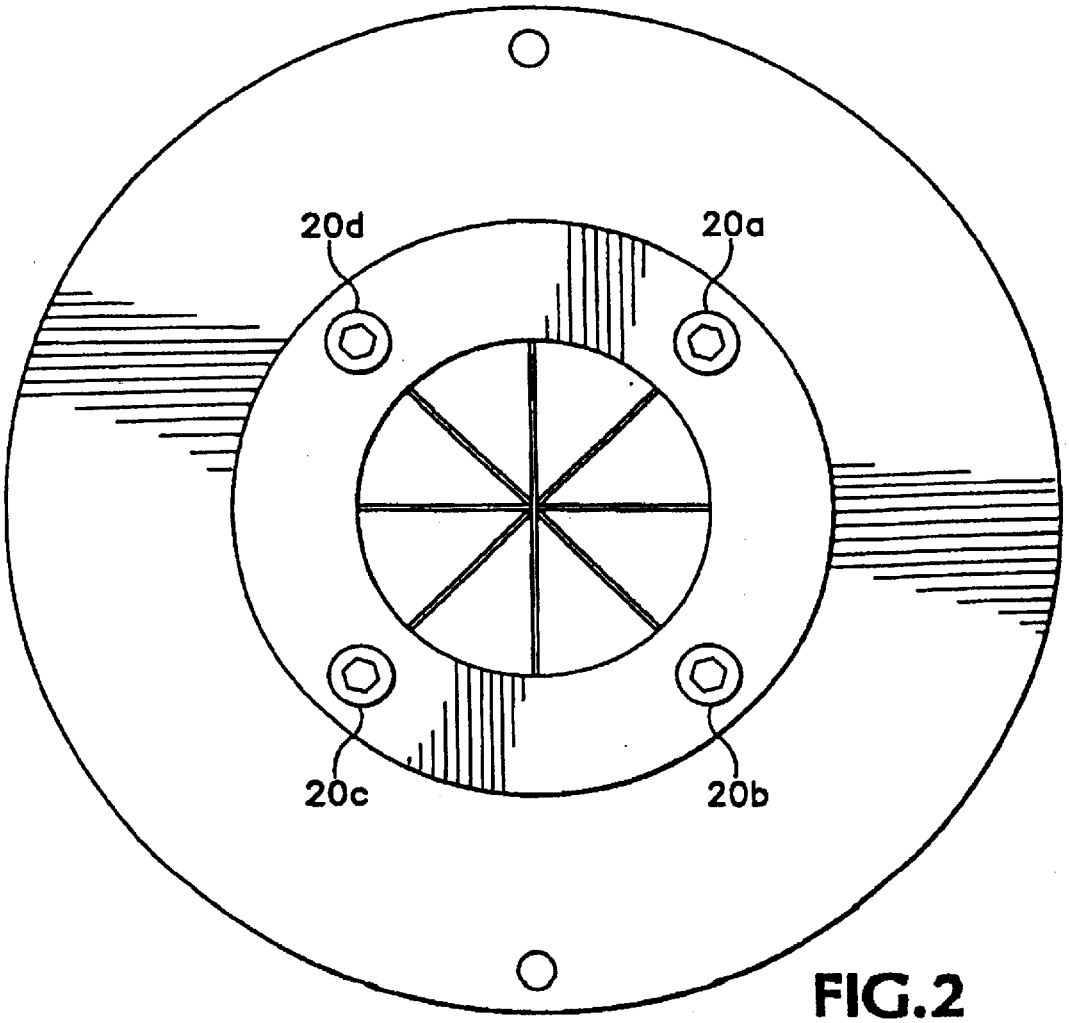
FIG. 2 is a bottom view of the cutter assembly shown in FIG. 1, and showing the central bore and four blades traversing the central bore and defining 8 wedge-shaped zones.
Figure 3:
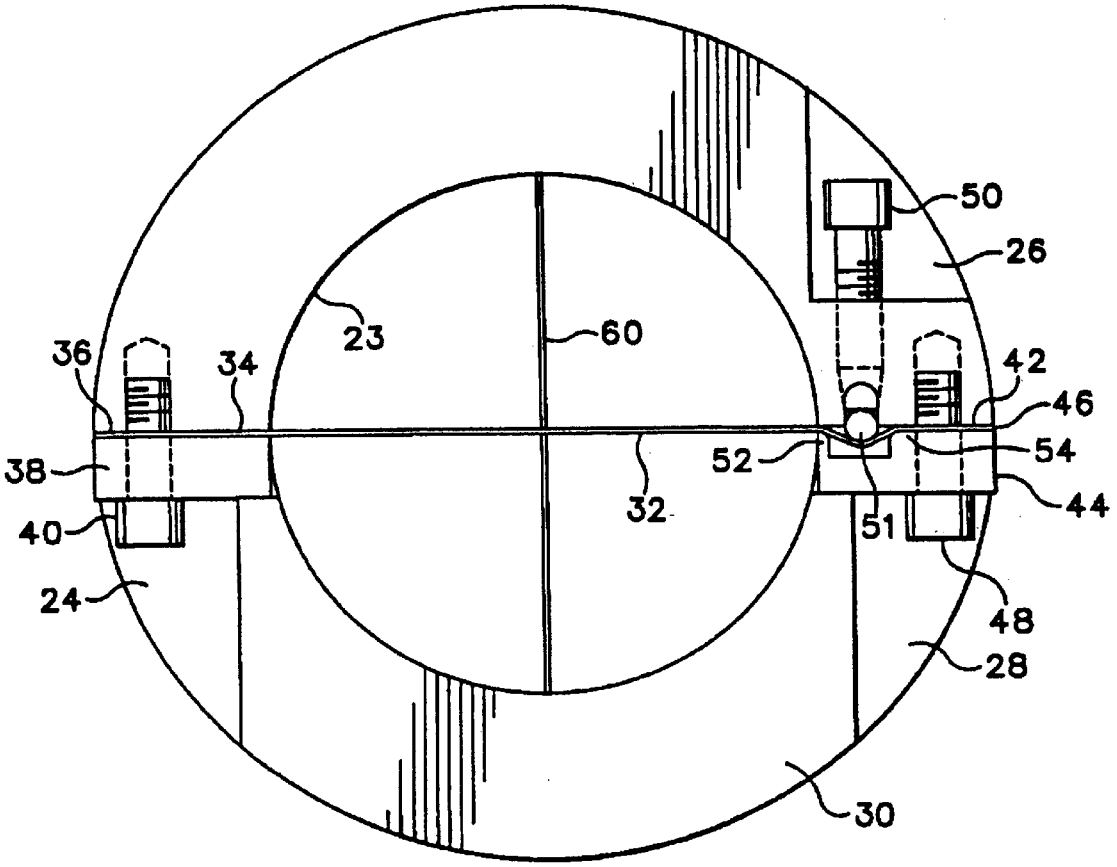
FIG. 3 is a bottom view of a two-blade cutter section shown in FIGS. 1 and 2, and showing the upper and lower cutting blades mounted therein, and the lower blade mounting and tensioning mechanisms.
Figure 4:
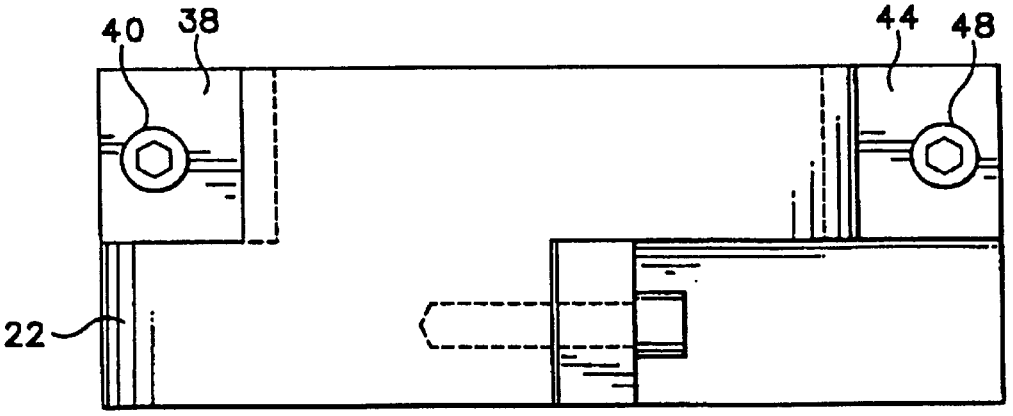
FIG. 4 is a left side elevational view of the two-blade cutter section shown in FIG. 3.
Figure 5:
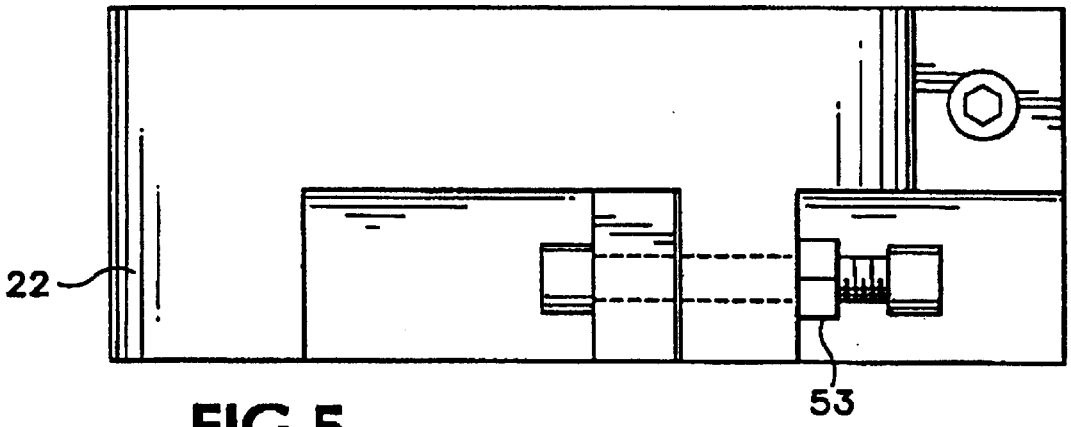
FIG. 5 is right side elevational view of the two-blade cutter section shown in FIG. 3.
Figure 6:
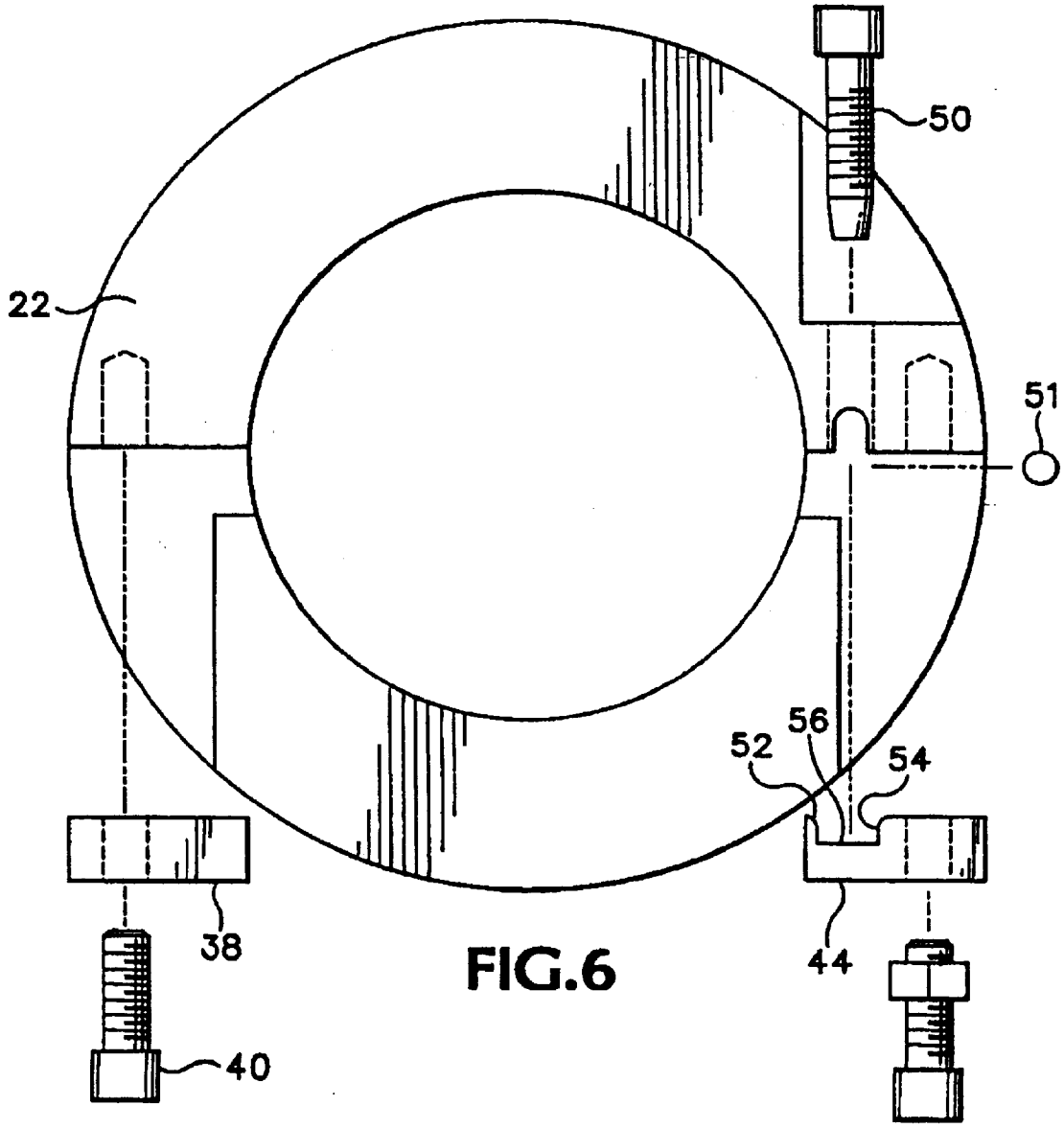
FIG. 6 is an exploded bottom view of the two-blade cutter section shown in FIG. 3, showing the mounting and tensioning apparatus for the blade mounted therein.

Turning now to FIG. 1, a wedge cutter assembly according to the invention is shown at 10. In the preferred embodiment, cutter assembly 10 is assembled from a bottom mounting plate 12, a lower 2-blade cutter section 14, an upper 2-blade cutter section 16, and an end retainer plate 18. The assembly is preferably made from stainless steel for food processing applications, although the invention is not limited thereto. Bolts 20*a–d* extend downwardly through end retainer plate 18 and cutter sections 14 and 16, and are threaded into holes in bottom mounting plate 12. Mounting plate 12 is provided for mounting cutter 10 in a food cutting system, such as a hydraulic food cutting apparatus (not shown). U.S. Pat. No. 4,807,503, which is hereby incorporated by reference, discloses hydraulic cutting system in which potatoes are entrained in a water stream and passed through a blade assembly which is mounted in a conduit. U.S. Pat. No. '503 teaches that it is advantageous to accelerate the food product as it approaches the blades. The same principle is applicable to this invention, although the cutter assembly of this invention can be used with other hydraulic cutting systems as well, and even with non-hydraulic cutting systems. As can be readily appreciated by reference to FIG. 2, the use of two cutter sections, each having two blades, produces 8 equal wedge-shaped portions in a single pass. In other embodiments, any even number of wedges can be produced by using different combinations of cutter sections and blades. A single cutter section can be used with one or two blades to produce two or four wedges. Three or more cutter sections, each with one or two blades, may be employed to cut 6 or 12 wedges, for example. Turning now to FIGS. 3–7, the details of a cutter section of the invention will be discussed. In FIG. 3, cutter section is shown generally at 22, and may be generally described as a cylindrical collar having an axial through bore 23, and having recessed areas 24, 26 and 28 milled into its top surface 30. A blade 32 traverses axial bore 23 and is mounted at end 34 between shoulder 36 and blade clamp 38. Bolt 40 secures blade clamp 38 and blade end 34 to shoulder 36. Blade end 42 is likewise clamped by blade clamp 44 to shoulder 46 by bolt 48. Blade ends 34 and 42 may be notched or drilled to receive the respective bolts 40 and 48. In order to precisely center blade 32 within axial bore 23, shoulders 36 and 46 are offset from the transverse centerline of the axial bore 23 by one-half the thickness of blade 32. For example, in one embodiment, the ends of blade 32 are 0.008" thick, and shoulders 36 and 46 are offset 0.004" from the transverse centerline of bore 23. Owing to the relatively thin cross-section of blade 32, which can range from 0.004 0.012", the blade is placed in tension to ensure that it remains centered and does not flex when impacted by the food product. Referring also to FIG. 8, the present invention includes a novel blade tensioning mechanism wherein a tensioning force is applied to blade 32 by turning adjustment screw 50 inwardly against a roll pin 51, which in turn urges blade 32 around blade tension anvils 52 and 54 and into recess 56 of blade clamp 44. Recess 56 has a width at least as great as the width of blade 32. Screw 50 is locked in place by locknut 53 (FIG. 5). Blade tension roll pin 48 preferably extends the full width of the blade 32, and is of a sufficiently large radius to avoid unduly high bending stresses in the blade at the point of contact with the roll pin 48. Applicant has found that a 3/16" diameter roll pin is suitable for blades having a thickness of 0.004 to 0.012" thick. Blade tension anvils 52 and 54 are also rounded in the preferred embodiment to minimize stress concentrations in blade 32, which if unchecked, could lead to premature failure of the blade. Although rounded roll pin and tension anvils to extend blade life, the invention is not limited thereto, and other profiles could be employed for the roll pin and tension anvils without departing from the scope of the invention.

Figure 7:
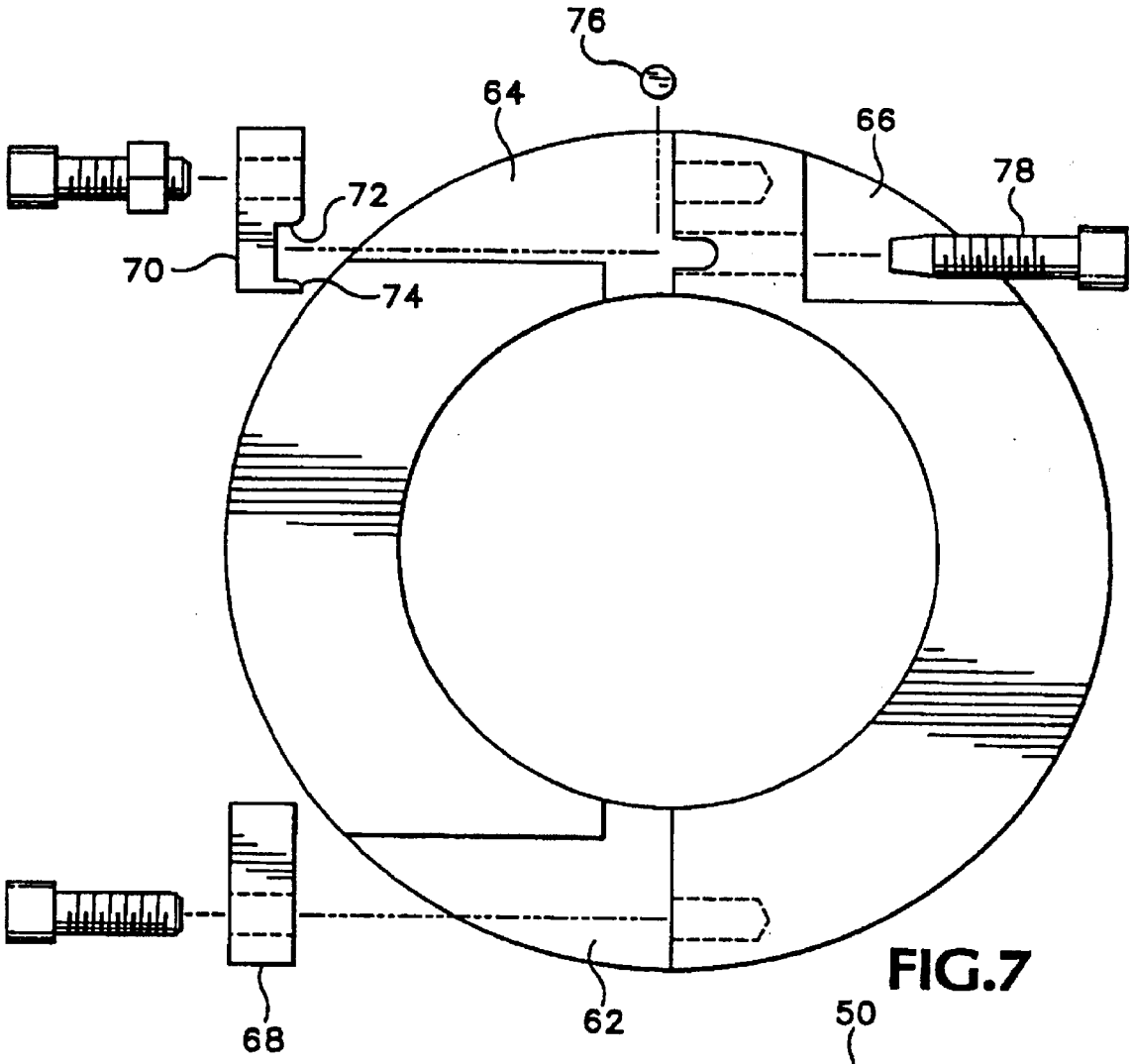
FIG. 7 is an exploded top view of the two-blade cutter section shown in FIG. 3, showing the mounting and tensioning apparatus for the blade mounted therein.
Figure 8:
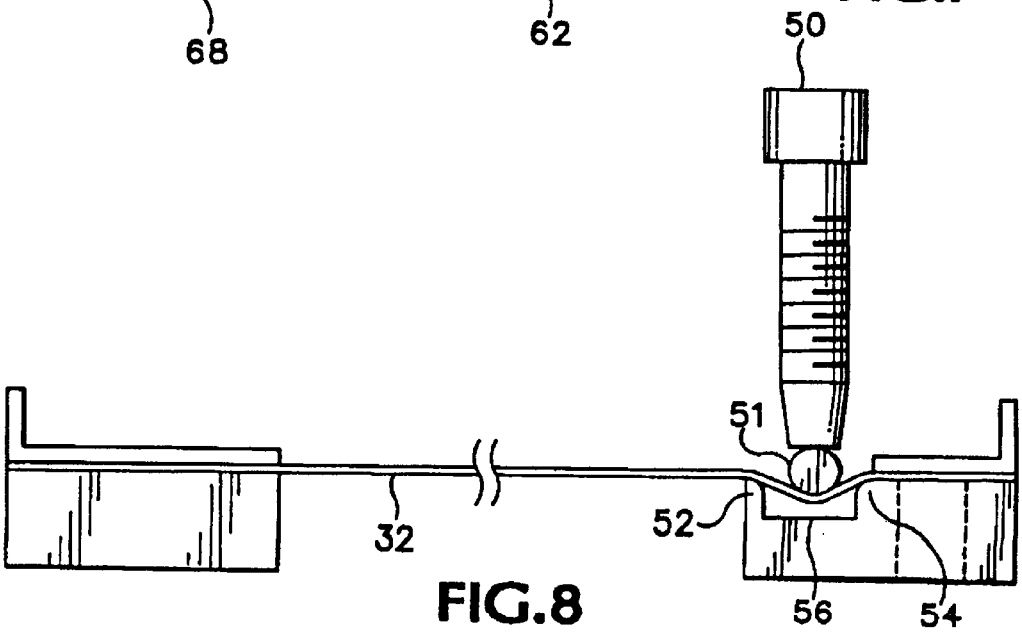
FIG. 8 is an enlarged partial bottom view of the two-blade cutter section shown in FIG. 3, and in particular the tensioning mechanism.

In the preferred embodiment, the bottom surface of cutter section 22 includes a second blade 60, recessed milled areas 62, 64, 66, blade clamps 68 and 70, shoulders 72 and 74, and a blade tensioning assembly (roll pin 76 and adjustment screw 78) which are identical to those described with respect to the top surface (FIG. 7). In the embodiment shown, blade 60 (FIG. 3) is rotated 90 degrees relative to blade 32 to provide four wedge portions per cutter assembly, and multiples of 4 wedges if multiple cutter assemblies are stacked. In other embodiments, different rotational offset between the upper and lower blades could be utilized. For example, three wedges can be produced by stacking a cutter section having two blades which are offset by 120 degrees instead of 90 degrees atop a cutter section having a single blade which is oriented at 120 degrees relative to each of the two lower blades. By varying the blade angles and stacking sections, literally any number of wedge shaped sections can be produced utilizing the invention.

Having described the invention in terms of the foregoing embodiments, those skilled in the art will recognize that one could modify the disclosed embodiments in numerous ways without departing from the scope and spirit of the following claims.

I claim:

1. A cutter comprising:

a first body having a first axial bore and first and second blade mounting surfaces;

a first elongate blade traversing the bore, the first blade having a first width and having first and second end portions attached to the respective first and second blade mounting surfaces;

the first body having surfaces defining a first recess underlying a portion of the first blade, the first recess having a width at least as great as the first width of the first elongate blade; and a first blade tensioner urging a portion of the first blade into the first recess.

2. A cutter according to claim 1 further comprising:

the body having third and fourth blade mounting surfaces a second elongate blade traversing the bore at an angle to the first blade, the second blade having first and second end portions attached to the respective third and fourth blade mounting surfaces;

the body having surfaces defining a second recess underlying a portion of the second blade; and, a second blade tensioner urging a portion of the second blade toward the second recess.

3. A cutter according to claim 1 wherein the first blade tensioner includes a first bearing member bearing on the first blade, and a first biasing member bearing on the first bearing member.

4. A cutter according to claim 2 wherein the second blade tensioner includes a second bearing member bearing on the second blade, and a second biasing member bearing on the second bearing member.

5. A cutter according to claim 3 wherein the first bearing member comprises a cylindrical pin.

6. A cutter according to claim 3 wherein the first biasing member comprises a threaded member.

7. A cutter according to claim 4 wherein the second bearing member comprises a cylindrical pin.

8. A cutter according to claim 4 wherein the second biasing member comprises a threaded member.

9. A cutter according to claim 1 wherein the first blade tensioner is adjustable, and wherein the first blade has a plurality of selectable tensions.

10. A cutter according to claim 2 wherein the second blade tensioner is adjustable, and wherein the second blade has a plurality of selectable tensions.

11. A cutter according to claim 1 further including:

a second body having a second axial bore communicating with the first axial bore, and fifth and sixth blade mounting surfaces;

a third elongate blade traversing the second bore, the third blade having first and second end portions attached to the respective fifth and sixth blade mounting surfaces;

surfaces defining a third recess underlying a portion of the third blade; and a third blade tensioner urging a portion of the third blade toward the third recess.

12. A cutter according to claim 11 further comprising:

the body having seventh and eighth blade mounting surfaces;

a fourth elongate blade traversing the second axial bore at an angle to the third blade, the fourth blade having first and second end portions attached to the respective seventh and eighth blade mounting surfaces;

surfaces defining a fourth recess underlying a portion of the fourth blade; and, a fourth blade tensioner urging a portion of the fourth blade toward the fourth recess.

13. A cutter according to claim 11 wherein the third blade tensioner includes a third bearing member bearing on the third blade, and a third biasing member bearing on the third bearing member.

14. A cutter according to claim 12 wherein the fourth blade tensioner includes a fourth bearing member bearing on the fourth blade, and a fourth biasing member bearing on the fourth bearing member.

15. A cutter according to claim 13 wherein the third bearing member comprises a cylindrical pin.

16. A cutter according to claim 13 wherein the third biasing member comprises a threaded member.

17. A cutter according to claim 14 wherein the fourth bearing member comprises a cylindrical pin.

18. A cutter according to claim 14 wherein the second biasing member comprises a threaded member.

19. A cutter according to claim 11 wherein the third blade tensioner is adjustable, and wherein the third blade has a plurality of selectable tensions.

20. A cutter according to claim 12 wherein the fourth blade tensioner is adjustable, and wherein the fourth blade has a plurality of selectable tensions.

21. A cutter comprising:

a first body having a first axial bore;

a first elongate blade mounted on the first body and traversing the first axial bore, the first elongate blade having a first width;

the first body having surfaces defining a first recess underlying a first portion of the first blade, the first recess having a width at least as great as the first width of the first elongate blade; and a first blade tensioner biasing the first portion of the first blade into the first recess.

22. A cutter according to claim 21 further comprising:

a second body having a second axial bore communicating with the first axial bore;

a second elongate blade mounted on the second body and traversing the second axial bore;

the second body having surfaces defining a first recess underlying a first portion of the second blade; and a second blade tensioner biasing the first portion of the second blade toward the second recess.

23. A cutter according to claim 21 wherein the first body includes mounting means for mounting the first body on an underlying surface.

24. A cutter according to claim 23 wherein mounting means includes a base member and means for removably attaching the first body to the base member.

25. A cutter according to claim 21 wherein the first elongate blade includes first and second ends, and wherein the cutter further comprises first and second clamping members clamping the respective first and second ends of the first blade to the first body.

26. A cutter according to claim 21 wherein the first blade tensioner includes a first pin bearing on a first blade portion adjacent the first recess, and a first threaded member bearing on the first pin.

27. A cutter according to claim 21 further comprising:

a second elongate blade mounted on the first body and traversing the first axial bore at a first angle to the first blade;

the first body having surfaces defining a second recess underlying a first portion of the second blade; and, a second blade tensioner biasing the first portion of the second blade toward the second recess.

28. A cutter according to claim 21 wherein the second elongate blade includes first and second ends, and wherein the cutter further comprises third and fourth clamping members clamping the respective first and second ends of the second blade to the first body.

29. A cutter according to claim 27 wherein the second blade tensioner includes a second pin bearing on the second blade adjacent the second recess, and a second threaded member bearing on the second pin.

30. A cutter according to claim 24 which further comprises a retainer atop the first body.

31. A cutter according to claim 30 wherein the retainer comprises a retainer plate mounted to the first body.

* * * * *